US007018014B2

(12) United States Patent
Koff

(10) Patent No.: US 7,018,014 B2
(45) Date of Patent: Mar. 28, 2006

(54) PRINTING BRAND SENSING BYPASS USING AN EMULATOR

(75) Inventor: Jeffrey M. Koff, Fairpool, NY (US)

(73) Assignee: Xerox Corporation, Stamford, CT (US)

( * ) Notice: Subject to any disclaimer, the term of this patent is extended or adjusted under 35 U.S.C. 154(b) by 982 days.

(21) Appl. No.: 09/749,562

(22) Filed: Dec. 28, 2000

(65) Prior Publication Data

US 2002/0085049 A1 Jul. 4, 2002

(51) Int. Cl.
*B41J 2/01* (2006.01)

(52) U.S. Cl. ..... 347/49
(58) Field of Classification Search ..... 347/7, 347/49, 86, 87, 19
See application file for complete search history.

(56) References Cited

U.S. PATENT DOCUMENTS

| | | | | | |
|---|---|---|---|---|---|
| 4,853,708 | A | * | 8/1989 | Walters | 347/86 |
| 5,138,344 | A | * | 8/1992 | Ujita | 347/19 |
| 5,712,669 | A | * | 1/1998 | Swanson et al. | 347/49 |
| 6,012,795 | A | * | 1/2000 | Saito et al. | 347/7 |
| 6,039,430 | A | * | 3/2000 | Helterline et al. | 347/19 |
| 6,062,667 | A | | 5/2000 | Matsui et al. | 347/19 |
| 6,142,600 | A | | 11/2000 | Takahashi et al. | 347/85 |
| 6,142,617 | A | | 11/2000 | Barinaga et al. | 347/23 |
| 6,151,041 | A | | 11/2000 | Bolash et al. | 347/19 |
| 6,325,495 | B1 | * | 12/2001 | Foth | 347/84 |

FOREIGN PATENT DOCUMENTS

| | | |
|---|---|---|
| EP | 0 623 471 A2 | 11/1994 |
| EP | 0 903 236 A2 | 3/1999 |
| EP | 0 993 954 A2 | 4/2000 |
| FR | 2 744 391 | 8/1997 |

* cited by examiner

*Primary Examiner*—Stephen Meier
*Assistant Examiner*—Blaise Mouttet
(74) *Attorney, Agent, or Firm*—Oliff & Berridge, PLC

(57) ABSTRACT

An emulator is provided for an ink tank. The emulator duplicates one or more of the ink tank features, which are sensed by a print engine to permit proper operation of the print engine. The emulator is an element designed to be attached to an ink tank which lacks one or more of the aforementioned ink tank features which are sensed by the print engine to ensure proper operation of the print engine. The emulator may attach to an ink tank which is placed into an ink tank receptacle or may fit by itself into the ink tank receptacle. The emulator will permit ink tanks to be used in print engines without the need to provide the one or more sensed features for each ink tank.

3 Claims, 5 Drawing Sheets

PRINTING BRAND SENSING BYPASS USING AN EMULATOR

BACKGROUND OF THE INVENTION

1. Field of Invention

The invention is directed to ink containers for print engines.

2. Description of Related Art

Ink containers or tanks are used in print engines such as, for example ink jet printers. Typically, ink tanks for ink jet printers or plotters have specific shapes. These ink tanks or cartridges are typically designed to fit only in specific printers or plotters. Usually, different brand ink tanks are designed to fit only in one brand of printer or plotter, and will not fit in other brand printers or plotters. Even within a given brand of print engines, such as, for example, printers and plotters, not all ink tanks or cartridges will fit into all of the printers or plotters of that brand. Many printers and plotters use ink tanks or cartridges which are replaceable by a user.

Some of these printers and plotters have mechanisms to sense whether or not a correct ink tank or cartridge is being inserted into the printer or plotter. If a user attempts to insert an incorrect ink tank or cartridge into a printer or plotter, the printer or plotter will reject it, at least in the sense that, even if the ink tank or cartridge fits into the printer or plotter, the printer or plotter may not operate unless and until it senses that a correct cartridge which it is designed to use has been inserted. Additionally, some ink tanks or cartridges will not fit properly into a particular printer or plotter, and the printer or plotter will not work unless the proper ink tank or cartridge fits properly into the printer or plotter.

SUMMARY OF THE INVENTION

This invention provides a method of emulating ink tank features which are sensed by a print engine.

This invention separately provides emulation elements which may be provided for a print engine and are positionable such that one or more print engine sensors detect the emulation elements as if the emulation elements were part of an ink tank usable in the print engine.

In various exemplary embodiments of the systems and methods according to this invention, specific emulation elements can be attached to an ink tank or cartridge. The ink tank or cartridge having an attached emulation element can then be properly inserted into the printer or plotter to act as an appropriate ink tank. As a result, the printer or plotter's ink tank evaluation mechanism, which is responsive to the one or more print engine sensors, treats an ink tank and the emulation elements as if that ink tank were an appropriate ink tank or cartridge designed for proper use in the print engine.

In various exemplary embodiments of the systems and methods according to this invention, an ink tank which does not have the appropriate features is provided with one or more emulation elements so that the ink tank can be used in a particular printer or plotter. The emulation element according to this invention permits a wide variety of ink tanks to be used with a printer or plotter that is designed not to operate unless and until it senses that an appropriate ink tank or cartridge has been properly inserted into the printer or plotter. The emulation element according to this invention permits modifications of ink tank geometry and ink tank supported functions without being limited to existing constraints on ink tank sensing.

Various exemplary embodiments of the ink tank usable with the systems and methods according to this invention include, but are not limited to, single ink tanks or cartridges containing multiple different colors in multiple separated containers within the same ink tank or cartridge. The multiple colors can be primary colors, highlight colors, dilute colors, e.g., for photoreal marking, or any other known or later-developed colored ink. Other exemplary embodiments of the ink tanks usable with the systems and methods according to this invention include large capacity ink tanks or cartridges usable within print heads normally designed for multiple ink tanks, and the use of custom single colors as specified by users.

Other exemplary embodiments of the system and methods according to this invention permit different brand ink tanks to be used in another brand of print engine.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
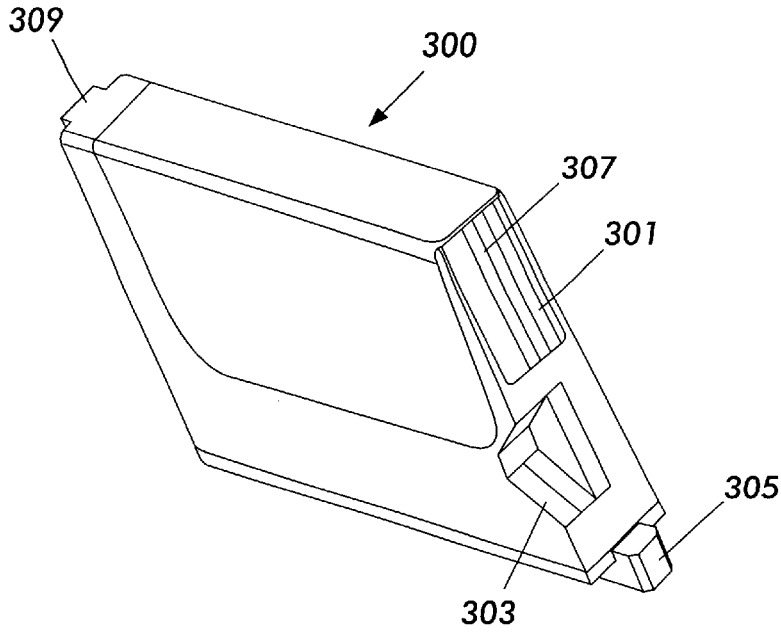
FIG. 1 is a perspective view of a conventional ink tank having sensible features which are sensed by a print engine.

FIG. 1 shows an ink tank 300 which is designed to fit into a specific ink tank receptacle of a print head (not shown). The ink tank 300 has a toe 305 which is designed to fit into a slot in this specific ink tank receptacle of a print head (not shown), identification elements 301 and 307, which are designed to be detected by a sensing device in the print engine containing the specific ink tank receptacle, and, optionally, an ink level viewing and/or indication element 303. Ink tank 300 has a tapered portion 309 which mates with ink tank receptacle latch element 409 (shown in FIG. 3). When inserted into a print engine, such as, for example, an ink jet printer or plotter, the sensing device of the printer or plotter outputs a signal to a controller of the print engine. The signal indicates that the ink tank 300 is an appropriate ink tank for this print engine. As a result, the controller permits the print engine to operate using ink from ink tank 300. If the controller determines, based on the signal from the sensing device that the ink tank 300 is inappropriate for the print engine, the controller will not allow the print engine to operate using that ink tank 300.

The slot in which the toe 305 fits, as well as any other mating and/or keying structure, is another type of sensor according to the principles of this invention, as an "appropriate" ink tank must have the corresponding mating and/or keying structure. Otherwise, an "inappropriate" ink tank lacking the corresponding mating and/or keying structure will not properly fit into the ink tank receptacle. Thus, the mating and/or keying structure of a receptacle "senses" whether or not the ink tank that the user attempts to install into that receptacle has a corresponding mating and/or keying structure. Similarly, the mating and/or keying structure can, by preventing an "inappropriate" ink tank lacking the corresponding mating and/or keying structure from fully fitting into the ink tank receptacle, ensure that any other sensible structures on that inappropriate ink tank are not placed appropriately relative to other sensors of the ink tank receptacle. As a result, these other sensors will not sense the other sensible structure, thus indicating that the "inappropriate" ink tank is truly inappropriate.

Figure 2:
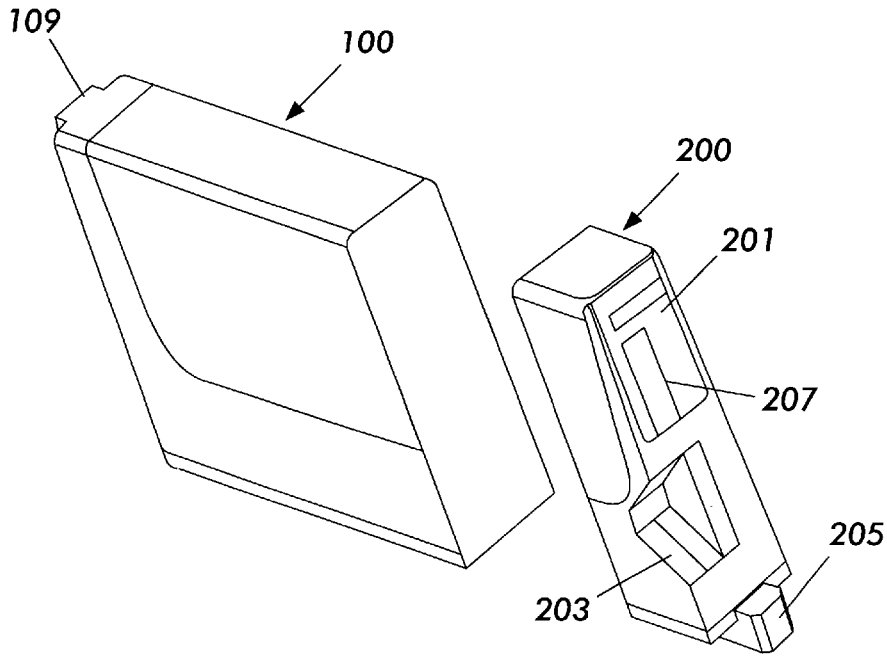
FIG. 2 is a perspective view of an ink tank which lacks the sensible features of the ink tank of FIG. 1 and one exemplary embodiment of an emulation device according to the invention.

FIG. 2 shows an ink tank 100 which lacks one or more sensible feature of the ink tank 300. For example, the ink tank 100 does not contain an ink identification element 301 of the ink tank 300. Ink tank 100 has a tapered portion 109 which mates with ink tank receptacle latch element 409 (shown in FIG. 3). The ink tank 100 also does not contain an ink level viewing and/or indication element 303. Nor does the ink tank 100 contain a toe 205 to permit the ink tank 100 to be properly inserted into an ink tank receptacle that is designed for ink tanks having features such as the ink tank 300. FIG. 2 also shows one exemplary embodiment of an emulation element 200 according to the invention. As shown in FIG. 2, in this exemplary embodiment, emulation element 200 includes an ink identification feature 201, an ink level viewing or indication feature 203, a toe feature 205, and a brand identification feature 207. It should be appreciated that the emulation element 200 may contain any one or more of ink identification features 201, ink level viewing or indication features 203, toe features 205, and brand identification features 207, depending on the set of features that, for any given ink tank receptacle and proper operation criteria, an "appropriate" ink tank will have. Thus, for example, if a particular ink tank receptacle is designed to accept a particular brand of ink tank 100 that has a toe 305 and a brand identification feature 302, then an emulation element 200 need only have a particular brand identification feature 207 and a toe feature 205 to render appropriate the ink tank 100 that lacks these features. The number and distinctiveness of the features may vary.

Figure 3:
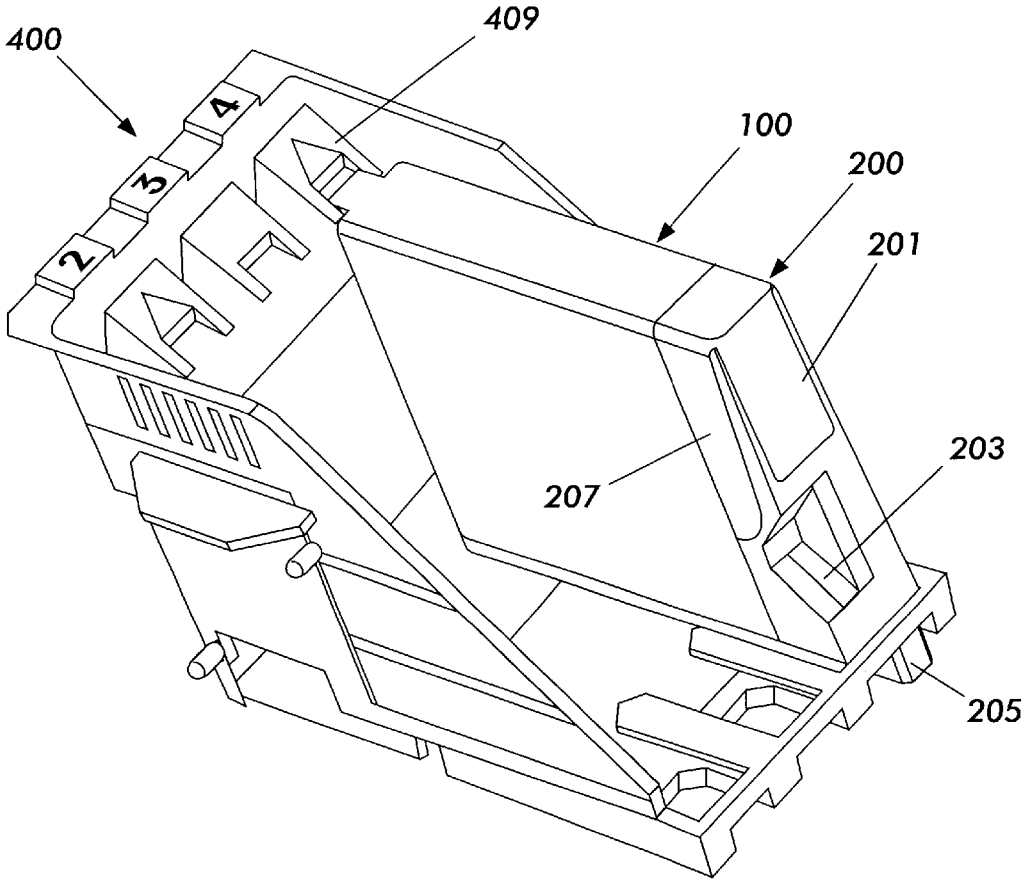
FIG. 3 is a perspective view of an ink tank and an emulation device according to this invention, located within an ink tank receptacle in a print engine designed to sense sensible features provided by the emulation device.

FIG. 3 shows an ink tank 100 which has been provided with the emulation element 200 according to this invention. As shown in FIG. 3, the ink tank 100 and the emulation element 200 is shown properly inserted into an ink tank receptacle 400 which is designed to accommodate the ink tank 300, as shown in FIG. 1, that has the ink identification feature 201, the ink level viewer or indicator feature 203, the toe feature 205 and the brand indicator 207. The emulation element 200 has been attached to the ink tank 100, which otherwise is not designed to appropriately fit into the ink tank receptacle 400. However, because the emulation element 200 has been attached to the ink tank 100, the ink tank 100 with the emulation element 200 interacts with the various features and sensors of the ink tank receptacle 400 and/or the print engine, such that the print engine containing the ink tank receptacle 400 cannot detect that the installed ink tank is an "inappropriate" ink tank 100, not the appropriate ink tank 300.

The emulation element 200 may be fit or attached to the ink tank 100 using any appropriate or known or later developed device, structure or material. For example, the emulation element 200 may be attached to ink tank 100 by an adhesive, or by Velcro® elements, magnets, screws, or tape. The emulation element 200 may be attached to ink tank 100 by a slip fit over the ink tank 100, or by a fit, including a snap fit, with male and/or female elements provided on the ink tank 100. Also, the emulation element 200 may be attached to ink tank 100 by any other suitable known or later-developed attachment device, material or mechanism.

Figure 4:
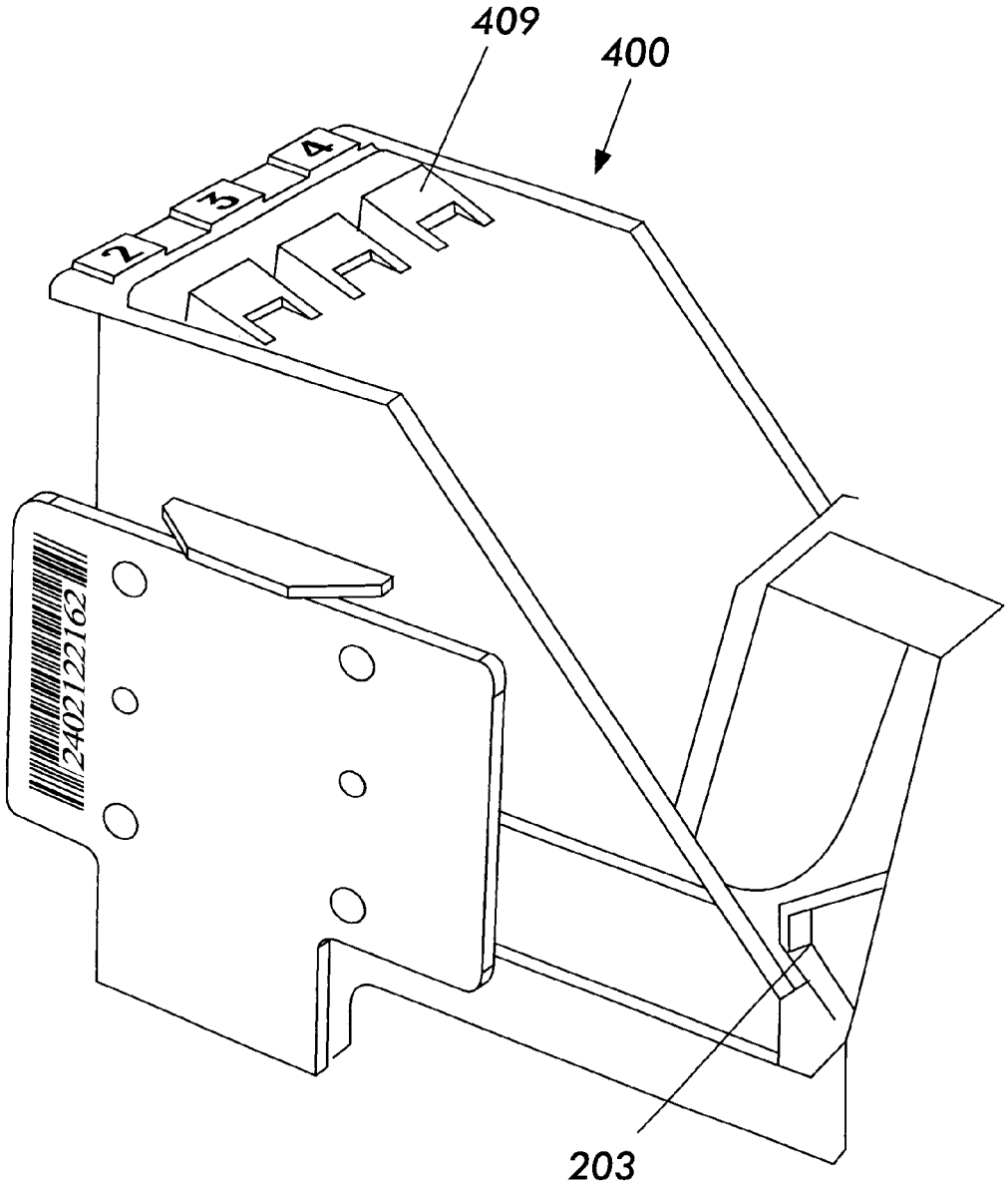
FIG. 4 is a perspective view of one exemplary embodiment of an emulation device according to this invention being inserted into an ink tank receptacle in a print engine designed to sense sensible features provided by the emulation device.

FIG. 4 shows the ink tank receptacle 400 which is designed to accept an ink tank 100 or 300 with or without an emulation element 200, with an emulation element 200 being inserted into the ink tank receptacle 400. The ink tank receptacle 400 is also designed to accept the emulation element 200 with or without an ink tank 100 or 300. FIG. 4 shows the relative dimensions of the ink tank receptacle 400 and of the emulation element 200, and shows an emulation element 200 inserted into an ink tank receptacle separate and apart from an ink tank 100. By inserting an ink tank emulation element 200 by itself into an ink tank receptacle 400, the ink tank emulation element 200 can be tested, and any desired changes or adjustments to the feature 201, the feature 203, the feature 205 and for the feature 207 can be made. For example, an ink identification indicator 207, such as, for example, a label, can be changed and tested. Of course, such testing can take place while an emulation element 200 is attached to an ink tank 100.

Figure 5:
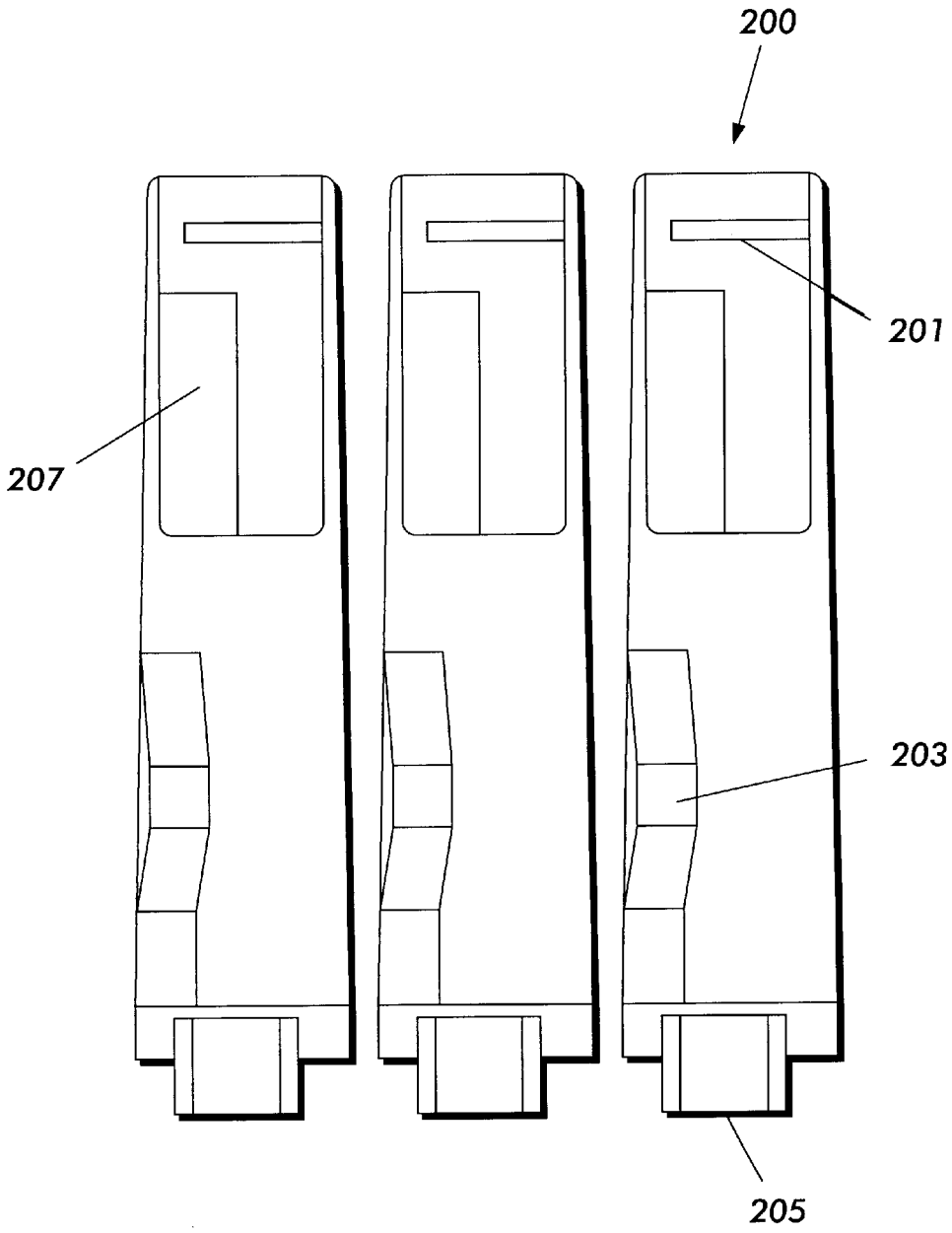
FIG. 5 is a front view of one exemplary embodiment of an emulation device according to the invention.
Figure 6:
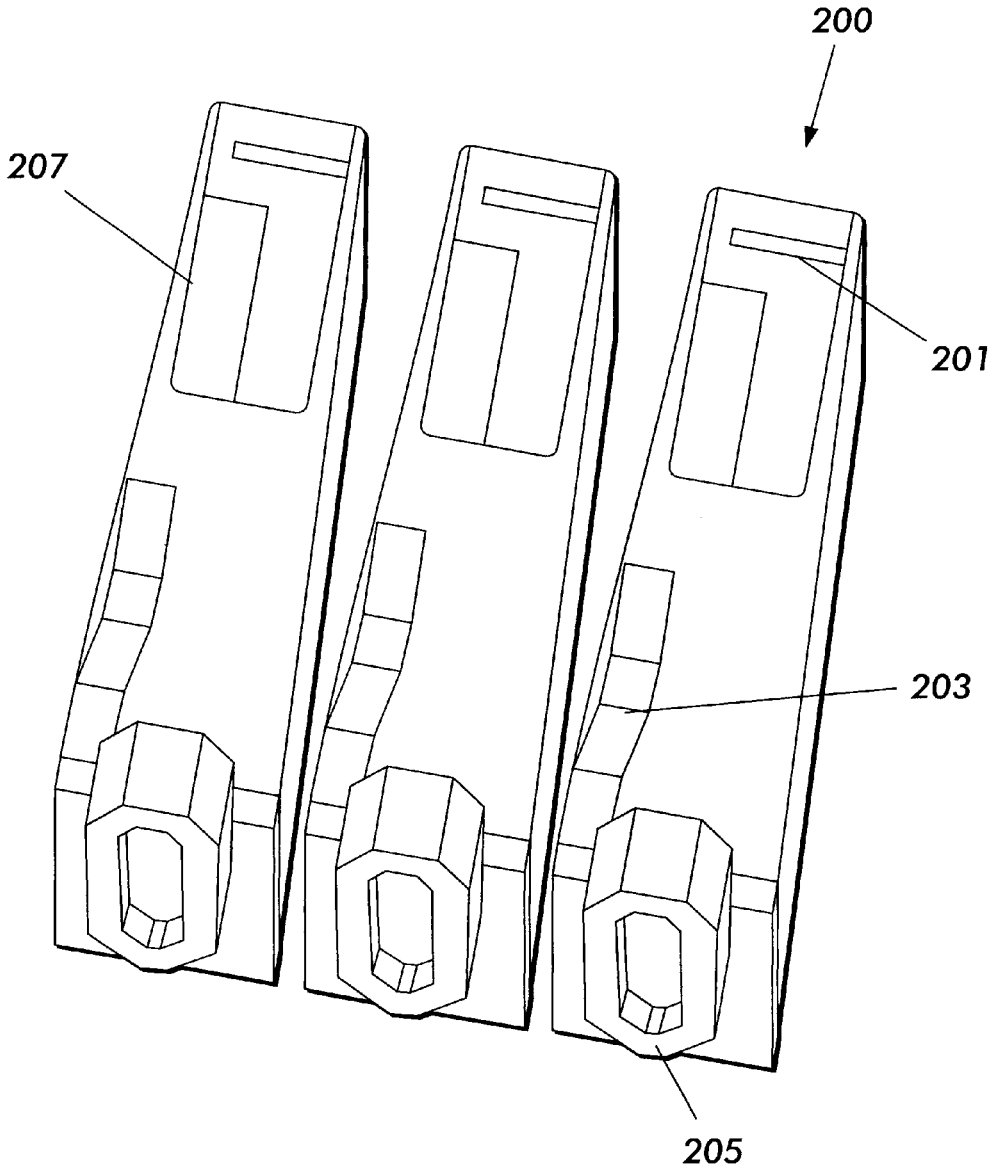
FIG. 6 is a perspective view of one exemplary embodiment of an emulation device according to the invention.

FIGS. 5 and 6 show a front plan view and a bottom perspective view, respectively, of the structural details of three emulation elements 200 in a side-by-side arrangement. These emulation elements 200 may be separate from each other or may be joined together. Each emulation element 200 can contain one or more of a toe portion 205, an ink identification feature 201, an ink level viewer and indicator 203 and an ink tank brand indicator 207. Depending on the ink tank receptacle, only one of each of these features may be desirable, or multiple instances of one or more of these features may be desirable.

The emulation elements according to this invention allow any ink tank to appear to be the type that is to be appropriately installed into a given ink tank receptacle in a print engine. The emulation elements according to this invention also allow one device, an ink tank with the emulator element, to appear as if that device were another device, such as, for example, an appropriate ink tank designed to be used with a particular ink tank receptacle in a particular print engine.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A method of permitting an ink tank which is configured for use in a first print engine without an emulator but is not configured for use without an emulator in a second print engine that is different from the first print engine, comprising:

associating an emulation element of the emulator, the emulator element having a predetermined configuration that permits the emulator to be installed in the second print engine, and configured with the ink tank, such that, when the emulation element is attached to the ink tank, the ink tank is rendered usable in the second print engine; and installing the ink tank and the associated emulation element in the second print engine, such that the combined ink tank and emulation element becomes operable in the second print engine.

2. The method of claim 1, further comprising attaching the ink tank and the emulation element to each other.

3. The method of claim 2, further comprising operating a print head with the installed ink tank and emulation element.

* * * * *